US006117009A

United States Patent [19]

Yoseloff

[11] Patent Number: 6,117,009

[45] **Date of Patent: *Sep. 12, 2000**

[54] METHOD AND APPARATUS FOR CONFIGURING A VIDEO OUTPUT GAMING DEVICE

[75] Inventor: Mark L. Yoseloff, Henderson, Nev.

[73] Assignee: Shuffle Master, Inc., Eden Prairie, Minn.

[ * ] Notice: This patent is subject to a terminal disclaimer.

[21] Appl. No.: 08/999,189

[22] Filed: Dec. 12, 1997

[51] Int. Cl.[7] ..... A63B 15/00

[52] U.S. Cl. ..... 463/20; 273/138.1; 273/143 R

[58] Field of Search ..... 463/20, 21, 22, 463/12, 13, 16–19; 273/143 R, 138 A, 138.1, 138.2, 139, 138; 364/717.01, 717.02, 717.05, 717.06

[56] References Cited

U.S. PATENT DOCUMENTS

| | | | |
|---|---|---|---|
| 4,095,795 | 6/1978 | Saxton et al. | 273/143 R |
| 4,448,419 | 5/1984 | Telnaes | 273/143 R |
| 4,573,681 | 3/1986 | Okada | 463/21 |
| 4,772,023 | 9/1988 | Okada | 273/143 R |
| 5,209,479 | 5/1993 | Nagao et al. | 463/21 |
| 5,219,167 | 6/1993 | Hamano | 273/143 R |
| 5,393,061 | 2/1995 | Manship et al. | 273/143 R |
| 5,423,539 | 6/1995 | Nagao et al. | 273/143 R |
| 5,456,465 | 10/1995 | Durham | 273/138 A |
| 5,569,084 | 10/1996 | Nicastro et al. | 463/20 |

*Primary Examiner*—Jessica J. Harrison
*Assistant Examiner*—Sheila Clayton
*Attorney, Agent, or Firm*—Jennifer K. Farrar

[57] ABSTRACT

A method of configuring a video output gaming device to randomly generate game outcomes is disclosed. The method includes the steps of selecting a set of game symbols, assigning a probability of occurrence to each symbol, selecting a plurality of outcome templates, each template comprising X variables, selecting a probability of occurrence for each outcome template, assigning a subset of symbols from the set of game symbols to each template for filling the positions, defining payouts for selected outcomes, and configuring a video output gaming device, which randomly selects a template, randomly selects a symbol for each variable in the template from the subset of game symbols assigned to the selected template, randomly fills at least a portion of the positions in the template and displays the outcome on a video output display. A video output gaming device programmed to randomly select a template, randomly select symbols to define the variables and randomly display the selected symbols is also disclosed.

35 Claims, 4 Drawing Sheets

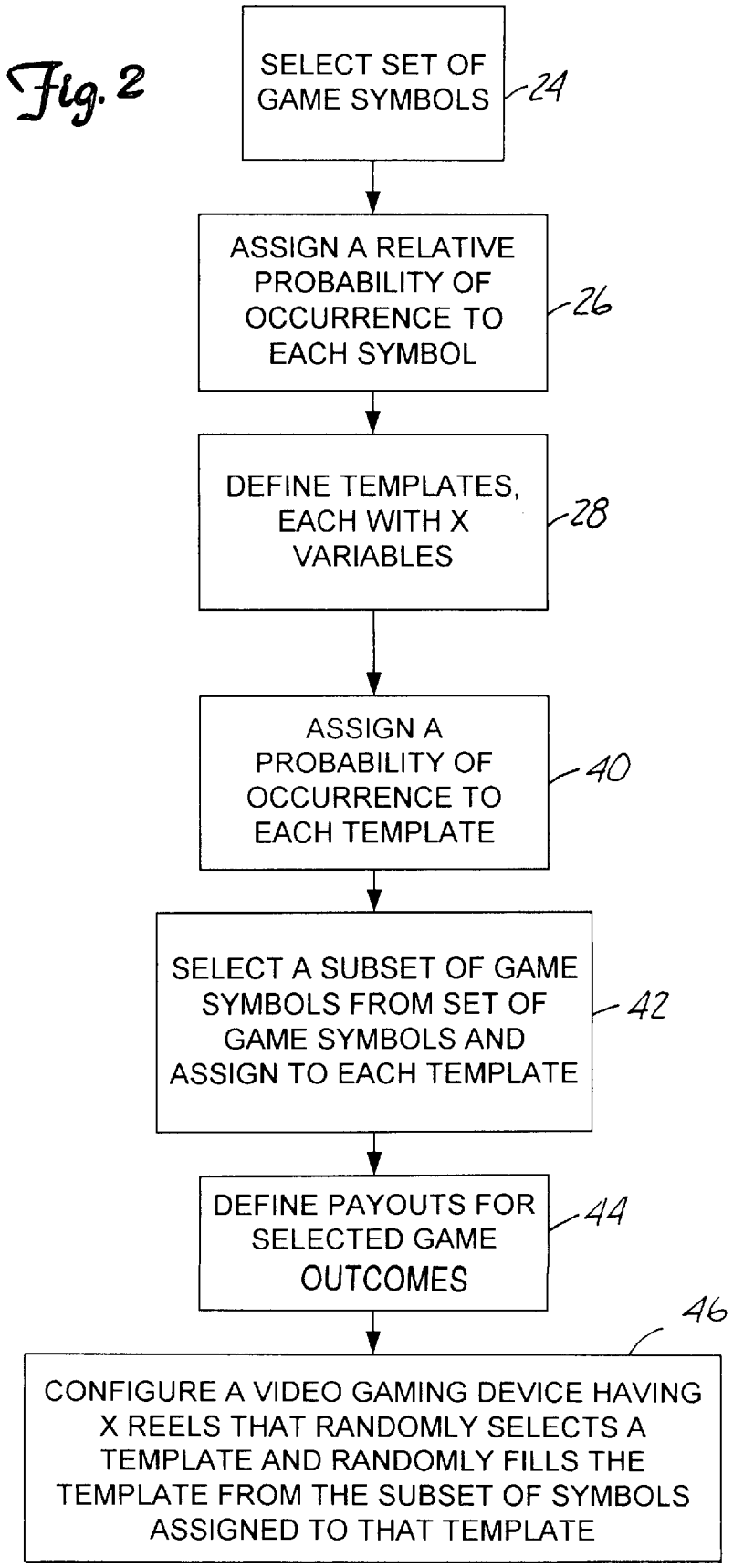
Fig. 2
SELECT SET OF GAME SYMBOLS
24
ASSIGN A RELATIVE PROBABILITY OF OCCURRENCE TO EACH SYMBOL
26
DEFINE TEMPLATES, EACH WITH X VARIABLES
28
ASSIGN A PROBABILITY OF OCCURRENCE TO EACH TEMPLATE
40
SELECT A SUBSET OF GAME SYMBOLS FROM SET OF GAME SYMBOLS AND ASSIGN TO EACH TEMPLATE
42
DEFINE PAYOUTS FOR SELECTED GAME OUTCOMES
44
46
CONFIGURE A VIDEO GAMING DEVICE HAVING X REELS THAT RANDOMLY SELECTS A TEMPLATE AND RANDOMLY FILLS THE TEMPLATE FROM THE SUBSET OF SYMBOLS ASSIGNED TO THAT TEMPLATE

METHOD AND APPARATUS FOR CONFIGURING A VIDEO OUTPUT GAMING DEVICE

BACKGROUND OF THE INVENTION

The present invention relates to games of chance. In particular, it relates to a method of configuring a video output gaming device to achieve a desired probability of occurrence of certain game outcomes. This application has been filed concurrently with and on the same date as my related application for Method and Apparatus for Configuring a Slot-Type Wagering Game whose disclosure is incorporated by reference.

Video output gaming machines are very popular in the United States and abroad. The types of games offered on video output wagering machines is diverse. Keno, Bingo, card games such as poker, blackjack, reel-slot game simulations and a variety of specialty card games, such as Five Deck Frenzy™, for example, are popular video output wagering games.

Video wagering games have achieved a high degree of consumer acceptance. A majority of the games are easy to learn, and offer interesting features such as colorful graphics and sound effects.

A majority of video output wagering machines are programmed to utilize video representations of symbols and have outcomes that are based on the random selection of symbols. If the outcome has been predetermined to be a winning outcome, a payout is made, according to a pay table.

Game designers are presented with the challenge of designing games that pay a prize frequently enough to maintain player interest, allow players a high enough payback to maintain an incentive to keep playing, and at the same time offer casinos a reasonable return on their investment. Player interest can be maintained in a variety of ways. Some players are interested in a game that awards frequent payouts to offer an incentive to continue to play. Other players are more interested in games which are designed to pay higher amounts less frequently. Since the success of a video game depends entirely upon the amount of play the game receives, selecting the right payout strategy for a particular game is of critical importance.

The design of a game, and more specifically the hit frequency of winning combinations and its pay table are matters of choice for the game designer. The choice of pay strategy and hit frequency depends in part upon the type of game being designed. With some games, it is believed that play is maximized with smaller, more frequent payouts. With other games, larger, less frequent payouts maximize play. With yet other games, combinations of large and small payouts generate the greatest player interest. The design of the winning outcomes and corresponding pay tables for purposes of this disclosure is referred to as "payout strategy."

It would be desirable to provide a method of designing a video output wagering game capable of randomly selecting outcomes that also has the flexibility of incorporating any desired types of payout strategy and hit frequency into the game.

SUMMARY OF THE INVENTION

A method of configuring a video output gaming device to randomly generate game outcomes is described. The method includes the step of selecting a set of game symbols. For example, the preferred "special symbol" game described in detail below is configured according to the present method includes six symbols. The next step is to assign a probability of occurrence to each symbol. The game designer preferably assigns a relative probability of occurrence to each symbol, so that the symbols in the game outcomes conform to the desired game pay strategy.

A plurality of outcome templates are next selected. Each template includes X variables. Each variable is preferably defined by a single symbol in each game outcome. Next, a probability of occurrence is assigned to each template according to the game designer's desired pay strategy.

A subset of symbols from the set of game symbols is selected and assigned to each template. Individual symbols from the set can be assigned to one or more template. The subsets of symbols define the outcome combinations which are possible within each template.

The method includes the step of defining payouts for preselected game outcomes. Preferably, a pay table is constructed to define the payout for all winning outcomes. The method of the present invention, in its broadest sense, includes the additional step of configuring a video output gaming device which randomly selects an outcome template, from a set of game templates, randomly selects symbols from the subset of game symbols assigned to the template to define each variable in the template, fills at least a portion of the template randomly with the selected symbols and displays the selected symbols on a video output display.

The present invention is a video output gaming device. The gaming device includes a support structure which preferably is a cabinet. Mounted in the support structure is a video output display and player controls. A microprocessor is also mounted in the support structure, and is in communication with the video output display and player controls. The microprocessor is programmed with a set of game symbols, a probability of occurrence for each game symbol, a plurality of outcome templates, a probability of occurrence of each outcome template and a subset of game symbols assigned to each template. A random number generator randomly selects an outcome template, and then randomly selects a plurality of game symbols for filling in the template. The game symbols are selected from the subset of game symbols assigned to the selected template. The device is programmed to award a payout if the game outcome corresponds to one of a preselected group of winning symbol combinations.

BRIEF DESCRIPTION OF THE DRAWINGS

FIG. 2 is a flow diagram of the steps included in the method of the present invention.

DETAILED DESCRIPTION OF THE PREFERRED EMBODIMENTS

The present invention is a method for configuring a gaming device to randomly select outcome symbols. The present invention permits the game designer to "tune" the probability of occurrence of certain outcome combinations independently of assigning a probability of occurrence to each individual symbol. The present invention advantageously allows the game designer more flexibility in incorporating a desired pay strategy into the game over known methods of design. The method of the present invention also advantageously permits random selection of individual symbols, rather than combinations of symbols.

The present invention applies to video output gaming devices such as stand alone video output wagering machines and multiple game platform machines. The method of the present invention can also be used to configure gaming machines that are part of a wide area progressive network or other type of progressive network.

Video output gaming machines employ a microprocessor with random number generation capability to determine game outcomes. Although the example described below illustrates how to configure a three matching symbol game, the method of the present invention can be used to design any video output wagering game which randomly selects symbol sets to achieve game outcomes. The present method is not only useful for configuring gaming devices whose object is to match like symbols, but also has application for games whose object is to match unlike symbols. The "special symbol" game, which is described in detail below as an example of the present method, includes game outcomes with three symbols.

Figure 1:
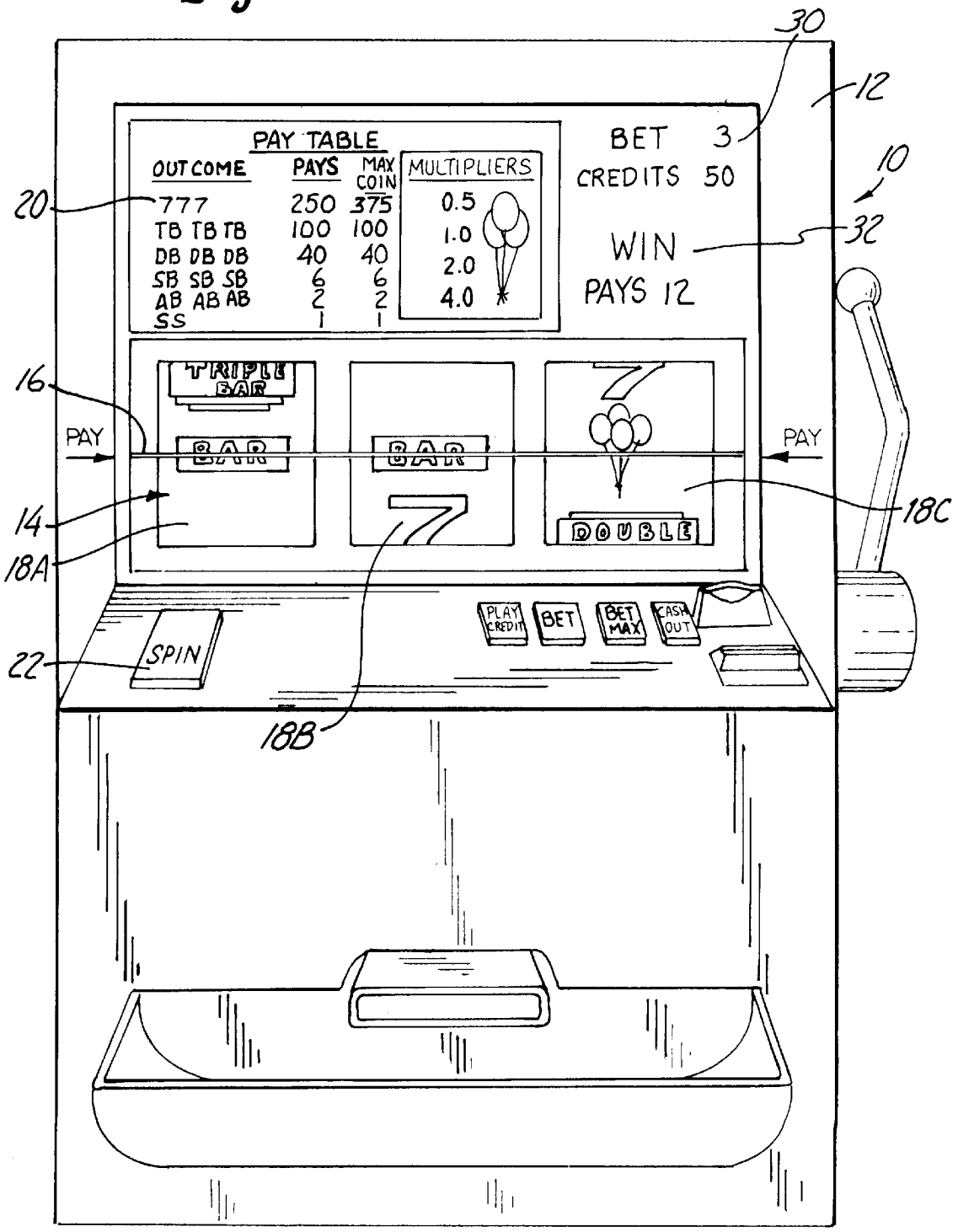
FIG. 1 is a front elevational view of the video wagering device of the present invention.

Referring now to FIG. 1, a video output reel slot simulation machine 10 configured according to the method of the present invention is equipped with a support structure which in the preferred embodiment is a cabinet 12. A microprocessor 48 is mounted in the cabinet (see FIG. 4). A display area 14 is provided with at least one pay line 16 and a visual display of video representations of a plurality of reels 18A, 18B and 18C. The reels preferably are at least partially visible in the screen display 14. Upon activation by depressing the "spin" button 22, a video representation of three spinning reels 18A, 18B and 18C appears on the screen display. The microprocessor 48 includes memory 56 and a random number generator 58. According to the preferred embodiment, video representations of three mechanical reels are provided. The microprocessor determines the symbols that will be displayed, and then communicates with the video output screen to display the selected symbols.

Referring now to FIG. 2, the first step in designing a video game according to the present method is to select a set of game symbols 24. In the most preferred game configured according to the present invention, the selected set of game symbols is: a balloon, red seven symbol, single bar, double bar, triple bar and blank. The balloon symbol according to the preferred method of the present invention serves several important functions. First, the symbol is a wild symbol. "Wild" for purposes of this disclosure means a symbol which takes on the value of other symbols appearing in the same game outcome. For example, in an outcome including two double bars and a balloon, the value of the wild symbol is double bars, and is therefore a winning combination, according to the pay table 20, as shown in FIG. 1.

The balloon symbol is merely one example of a special symbol of the preferred method of the present invention. The special symbol preferably not only acts as a wild symbol, but according to the preferred method of the present invention, serves two additional functions. The preferred special symbol is a "doubler." That is, all pay values are doubled when a special symbol is part of the outcome in the underlying game. For example, in FIG. 1, the player has bet three coins (maximum bet), as shown in the "bet" area 30 of the screen display. The player depresses the spin button 22, and the symbols appearing on the pay line 16 are bar, bar, balloons. According to the pay table 20, three bars pays 6 to 1. Since the special symbol appears as part of the game outcome, the payout doubles to 12 to 1 as shown in the "win" area 32 of the screen display.

Figure 3:
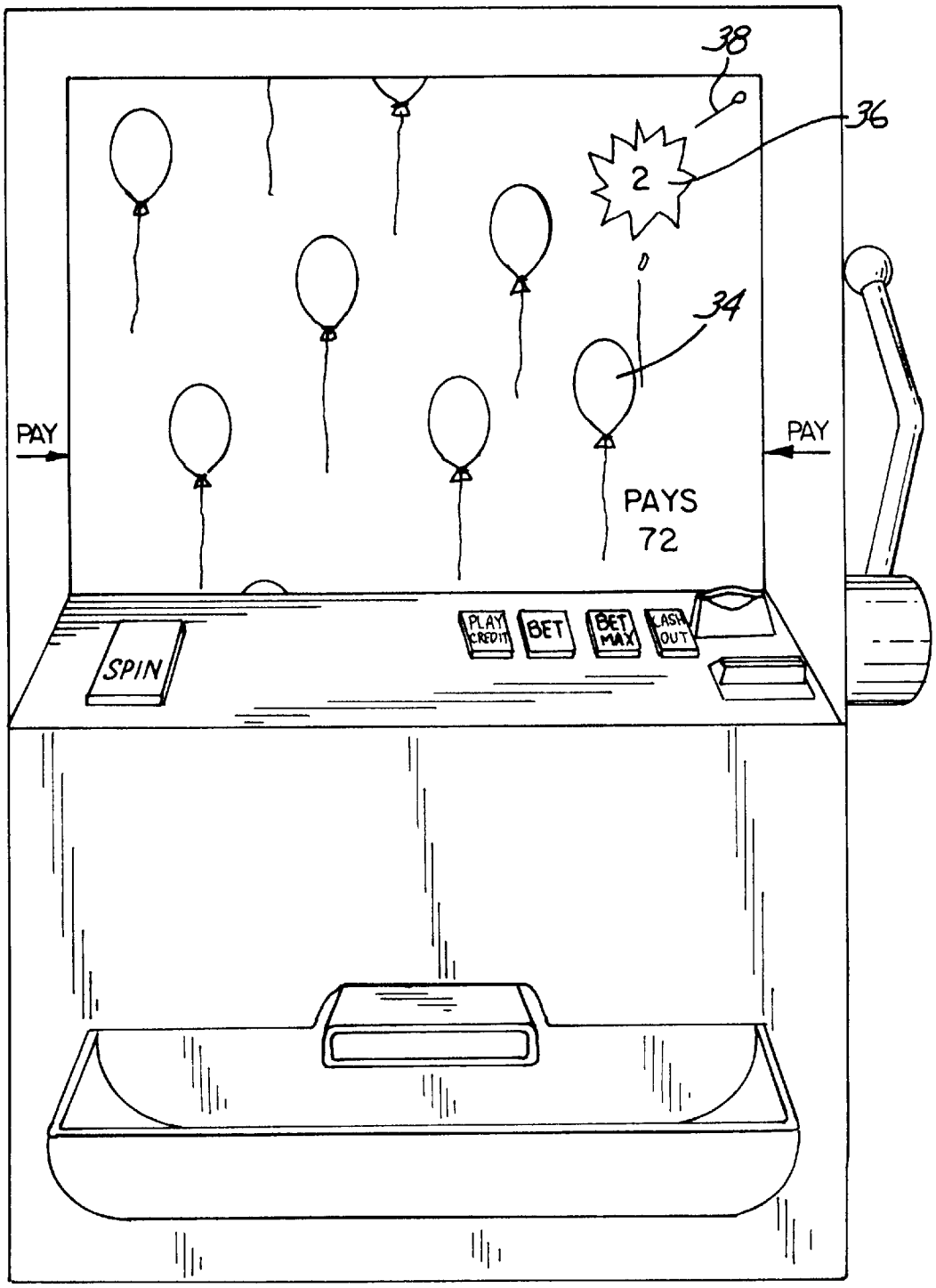
FIG. 3 is a front elevational view of the preferred device, illustrating the second screen feature.

Preferably, the special symbol feature activates a second screen feature, as shown in FIG. 3. Preferably, the player cannot collect the win until the player selects one of a number of balloons 34 floating up the screen. Preferably, a touch screen display is provided to enhance the preferred second screen feature. When the player touches the balloon 36 he has selected, a pin 38 appears and bursts the balloon, revealing a multiplier. Preferably, this multiplier is greater than zero so that the player does not put his entire winnings at risk by playing the second screen game. The second screen feature is described in more detail in my copending application for Method of Scoring a Video Wagering Game, filed Mar. 12, 1997, and assigned U.S. Ser. No. 08/820,438 whose disclosure is herein incorporated by reference.

Preferably, the multipliers are selected from the group: 0.5, 1.0, 2.0 and 4.0. Alternatively, the multipliers are other values. The player randomly selects the multiplier, preferably by touching the selected balloon on the touch screen display. The balloon bursts, revealing a multiplier equal to 2. In this example, the player is paid 24 to 1, or 72 coins on his maximum 3 coin bet.

Preferably, the set of selected game symbols is subdivided into a plurality of symbol groupings. Symbols within a given grouping typically perform a same or similar function, but functional similarity is not required. In the preferred method, the set of six game symbols is divided into the following symbol groupings identified in Table I below:

TABLE I

| Symbol Grouping | Symbol |
|---|---|
| 1 | Balloon |
| 2 | Seven |
| 3 | Triple Bar, Double Bar, Single Bar |
| 4 | Blank |

Although in this example, only the third symbol grouping includes more than one symbol, the present invention contemplates including one or more symbols in each grouping. The number of groupings defining a game can vary according to the present invention. In the example, six symbols, separated into four symbol groupings, define the entire set of game symbols. The game designer may choose a wide variety of symbols, and group them in any manner desired.

Any symbols capable of being distinguishable from other symbols in the group can be used according to the method of the present invention. For example, a deck of 52 conventional cards could define the group of game symbols. The game symbols could then be divided into thirteen groupings of four each, corresponding to Aces, Kings, Queens, Jacks, Tens, nines, eights, sevens, sixes, fives, fours, threes and twos. Examples of other suitable game symbols include animals, food, numbers, letters, shapes and colors.

The next step according to the method of the present invention is to assign a relative probability of occurrence to each symbol 26. In the preferred method of the present invention, the following relative probabilities are assigned to each symbol and are provided in Table II below:

TABLE II

| Symbol | Frequency | Relative Probability |
|---|---|---|
| Balloon | 1 | 0.003861 |
| Red Seven | 2 | 0.007722 |
| Triple Bar | 16 | 0.061776 |
| Double Bar | 40 | 0.15444 |
| Single Bar | 100 | 0.3861 |
| Blank | 100 | 0.3861 |
| Total | 259 | 1 |

The probability of occurrence of each individual symbol is the frequency of occurrence of that symbol divided by the total number of symbol occurrences. For example, the probability of occurrence of blank is 100/259 or 0.3861.

According to the method of the present invention, the game designer next selects a plurality of outcome templates 28. What is meant by an "outcome template" for purposes of this disclosure is a combination of X variables which are defined by the random selection of symbols from a subset of game symbols assigned to the template. Each template therefore represents a set of one or more possible combinations of symbols. Preferably, the set of game templates includes all outcome combinations possible with the set of game symbols. In another embodiment, selected outcomes are excluded from the possible game outcomes. According to the present invention, the number of positions within each template defining the game remains constant. In the first example of designing a game according to the preferred method, each template has three variables, each corresponding to a video representation of a reel.

Each template is preferably defined by a combination descriptor, a range of possible symbol values for each element of that combination descriptor, restrictors and an optional position flag. The combination descriptor describes the number of and type of game symbols which will appear in the final outcome, without regard for the order. For example, the combination descriptor A A A represents an outcome of three identical symbols. The order of appearance is unimportant in this example. In contrast, the combination descriptor A B C represents three different symbols, appearing in no particular order.

Certain letters, for example, A, B and C are identified as "active" elements, while other letters, for example, X, Y and Z are identified as "inactive elements" in the templates. Game templates can include active, inactive or combinations of active and inactive elements. What is meant by an "active" element for purposes of this disclosure is a variable that may be defined by one or more symbols in an outcome that can be part of a winning combination. An "inactive" element for purposes of this disclosure is one or more symbols in an outcome that is a losing outcome. The same symbol which may be active in one template may be inactive in another template, according to the present invention. Certain designated "active" symbols may also be combined with "inactive" symbols to form a winning outcome. The present invention therefore also contemplates the use of templates that have a combination of active and inactive symbols which produce winning outcomes. According to the method of the present invention, only combination descriptors having at least one active element produce winning outcomes.

Referring back to FIG. 2, according to the method of the present invention, each template is provided with a relative probability of occurrence 40. The game designer assigns the relative probability of occurrence to each template, independent of the assigned probabilities of the individual game symbols. The preferred game templates and assigned probabilities are provided in Table III below:

TABLE III

| Template | Relative Probability |
|---|---|
| 1 | 0.017123 |
| 2 | 0.001712 |
| 3 | 0.042808 |
| 4 | 0.059932 |
| 5 | 0.006849 |
| 6 | 0.015411 |
| 7 | 0.428082 |
| 8 | 0.256849 |
| 9 | 0.171233 |
| | 1 |

The method of the present invention includes assigning a subset of symbols from the set of game symbols to each template 42. The subsets of symbols in Table V below, are defined by "range," "grouping," "restrictor" and "position flag" information.

Range and grouping information are provided for each individual template, according to the preferred method. Restriction and position flag information is optionally assigned to each template.

The range information defines the minimum and maximum number of different symbols from each symbol grouping that can be used to fill each variable in the template. The range information has been defined in Table V, below, in terms of the symbol groupings identified in Table I, above. However, it is not necessary to tabulate the information in this manner. In the preferred game of the present invention, six symbols are arranged in symbol groupings one through four.

As an example of how the range and grouping data are used, Template 1 will be described in detail. Template 1 is defined by combination descriptor A A A. According to the range and grouping information, the "A" symbol can be selected from symbol groups 2 or 3. There is a maximum of one symbol from each of the symbol groupings, according to the "maximum grouping" information provided and a minimum of zero symbols from symbol groupings 2 and 3. Referring back to Table I, variable A can be either a seven, a triple bar, a double bar or a single bar. The subset of symbols assigned to Template 1 defines all possible outcomes as:

seven, seven, seven triple bar, triple bar, triple bar double bar, double bar, double bar single bar, single bar, single bar Template 2 is defined by the combination descriptor A A B. Variable B includes a restriction. B is restricted to a symbol from symbol grouping 1. That is, B must be a balloon. The maximum and minimum value is one from symbol grouping 1. As to the value of A, it must be a symbol that is different from B because the combination descriptor A A B requires A and B to be different. A is selected from the groups 2 and 3. The possible symbols used to fill the variable for A is therefore a seven, triple bar, double bar and single bar. Since there are no inactive variables in Template 2, the "inactive" portion of the table describing Template 2 indicates a "N/A." The subset of symbols corresponding to Template 2 defines all possible outcomes as:

seven, seven, balloon triple bar, triple bar, balloon double bar, double bar, balloon single bar, single bar, balloon Position flags place additional requirements on how the variables in the template are defined. In the preferred game utilizing the templates defined in Table V, position flags are defined in Templates 2 and 6. In both templates, the active element is a balloon symbol, and the symbol must appear as the third symbol in the sequence of the game outcome. The position farthest to the right on the pay line in the preferred example is the only position in which the special symbol pays. In other words, Templates 2 and 6 define positional wins.

According to the method of the present invention, payouts are defined 44 and are assigned to each outcome. The payout can be zero or greater. Payouts of zero correspond to losing outcomes.

In the example described above, the preferred pay table is as follows:

TABLE IV

| Pay Table | | | | | |
|---|---|---|---|---|---|
| Combination | | | Pays | Maximum Coins | Maximum Coin Bonus/Coin |
| 7 | 7 | 7 | 250 | 375 | 125 |
| TB | TB | TB | 100 | 100 | |
| DB | DB | DB | 40 | 40 | |
| SB | SB | SB | 6 | 6 | |
| AB | AB | AB | 2 | 2 | |
| X | X | SS | 1 | 1 | |

Where DS is double symbol, 7 is a red seven, TB is a triple bar, DB is a double bar, SB is a single bar, AB is any bar and SS is a special symbol.

In addition to the pay table defined above, the following additional rules apply to scoring a game configured according to the preferred method of the present invention: The special symbol functions as a wild symbol and is used to complete any winning combination. Special symbols double the value of a winning combination when used to complete that combination. The pay is preferably multiplied by the value of the multiplier randomly selected by the player in the second screen feature of the game. In the "special symbol" game example, the multiplier is equal to 0.5, 1.0, 2.0 and 4.0. The appearance of the special symbol in the game outcome preferably requires the player to participate in a second screen feature. In another embodiment of the method of the present invention, the player can decline to participate in the second screen game and accept the pay value of the game outcome from the underlying game.

According to the present invention, a video output gaming device having X variables is next configured 46. The game microprocessor is programmed to select a template from the group of game templates. The template variables are defined by the random selection of symbols from the subset of symbols assigned to the template. According to the method of the present invention, the symbols from the subset are randomly selected, and the order in which each variable is defined is also randomly selected. For templates including a position flag, the flagged position is filled first.

Table V summarizes the preferred subsets of symbols corresponding to each game template, numbered one through nine. It should be noted that in this example, templates one to nine represent all possible outcomes for the selected set of game symbols in the game designed according to the preferred method of the present invention. In another example, the templates defining all game outcomes defines fewer than all possible outcomes for a given set of game symbols. For example, the game designer might want to eliminate a percentage of the outcomes that are losers, such as outcomes containing three blanks.

TABLE V

| | | | Range | | |
|---|---|---|---|---|---|
| No. | Combination Descriptor | Active/ Inactive | Minimum Grouping 1 2 3 4 | Maximum Grouping 1 2 3 4 | Position Flags 0 0 0 |
| 1 | A A A | Active | 0 0 0 0 | 0 1 1 0 | 0 0 0 |
| | | Inactive | N/A | N/A | |
| 2 | A A B | Active | 1 0 0 0 | 1 1 1 0 | 0 0 1 |
| | | B Restrict | 1 0 0 0 | | |
| | | Inactive | N/A | N/A | |
| 3 | A A B | Active | 0 0 2 0 | 0 0 2 0 | 0 0 0 |
| | | Inactive | N/A | N/A | |
| 4 | A B C | Active | 0 0 3 0 | 0 0 3 0 | 0 0 0 |
| | | Inactive | N/A | N/A | |
| 5 | A B C | Active | 1 0 2 0 | 1 0 2 0 | 0 0 0 |
| | | A Restrict | 1 0 0 0 | | |
| | | Inactive | N/A | N/A | |
| 6 | X Y A | Active | 1 0 0 0 | 1 0 0 0 | 0 0 1 |
| | | Inactive | 0 0 0 0 | 0 1 1 1 | |
| 7 | X X X | Active | N/A | N/A | 0 0 0 |
| | | Inactive | 0 0 0 1 | 0 0 0 1 | |
| 8 | X X Y | Active | N/A | N/A | 0 0 0 |
| | | Inactive | 0 0 0 0 | 0 1 1 1 | |
| 9 | X Y Z | Active | N/A | N/A | 0 0 0 |
| | | Inactive | 0 0 0 0 | 0 1 2 1 | |

As another example of how the combination descriptors define all possible combinations for the selected template, Template 7 will be described. Template 7 is an inactive combination descriptor. That is, all outcomes defined by this template are losing combinations. The minimum and maximum symbol groupings indicate that there is a minimum and maximum of one symbol from symbol grouping 4. Symbol grouping 4 includes blanks. Combination descriptor X X X describes the following outcome:

blank, blank, blank

Templates including active and inactive elements list the active and inactive ranges separately. For example, Template 6 is X Y A. The inactive portion of the template, X is selected from groups 2, 3 and 4. Referring back to the table of groupings, X is therefore defined as a seven, any bar or a blank.

During play of the game, a random number generator which is preferably an integral part of the microprocessor selects the game template, based on the assigned probability of occurrence of all templates. The template probabilities are chosen by the game designer.

The specific symbols which fill the template are randomly selected from the subset of symbols assigned to that template, based on the relative probability of occurrence of all eligible symbols for that template. Positions requiring active elements are randomly filled first, and then positions requiring inactive elements are randomly filled.

Another feature of the method of the present invention is that the random number generator selects the order in which the positions within the template are filled. If a position restriction exists in a template, that position is filled first; then the remaining symbols are randomly selected to define the outcome. The microprocessor then causes the video output display to show the selected symbols.

The frequency of occurrence for each template in the first example of a game configured according to the present invention is shown in Table VI:

TABLE VI

| Template No. | Frequency of Occurrence |
|---|---|
| 1 | 1,000 |
| 2 | 100 |
| 3 | 2,500 |
| 4 | 3,500 |
| 5 | 400 |
| 6 | 900 |
| 7 | 25,000 |
| 8 | 15,000 |
| 9 | 10,000 |
| Total | 58,400 |

The probability of occurrence of each individual template is the frequency of occurrence of the template divided by the total number of occurrences of any template in the game. For example, the probability of occurrence of any combination of symbols represented by Template 9 is 0.1712 (10,000/58,400).

The individual probability of occurrence of each possible outcome within a given template is dependent in part upon the probability of occurrence of each symbol in the outcome, as well as the probability of occurrence of the selected template. For example, with Template 2, the combination descriptor is A A B. The probability assigned to Template 2 is 0.001712. B is restricted to a "special symbol," and the position flag indicates that the special symbol appears on the third position on the video output display. Variable A is selected from symbol groups 2 or 3. Variable A is therefore a red seven, or any bar. The possible outcomes are:

bar bar SS

DB DB SS

TB TB SS 7 7 SS

The special symbol is wild, and therefore the probabilities of each separate combination are calculated as though all symbols are identical.

The probability of occurrence of bar-bar-SS is the probability of occurrence of Template 2, times the probability of occurrence of a single bar, divided by the sum of the probabilities of occurrence of all symbols assigned to the subset corresponding to Template 2.

$$P = \frac{0.001712(.3861)}{(.007722 + .061776 + .15444 + .3861)} = .001084$$

When the symbols in the outcome are not alike, as in Template 3, the manner in which the probability of occurrence of each outcome in the template is determined slightly differently.

For example, the subset of symbols corresponding to Template 3 (A A B)includes six possible outcomes. A summary of all possible outcomes and corresponding probabilities of occurrence for Template 3 is listed in Table VII below:

TABLE VII

| Outcome | Probability |
|---|---|
| DB DB TB | .001514 |
| DB DB SB | .009462 |
| SB SB DB | .019601 |
| TB TB SB | .003136 |
| TB TB DB | .001254 |
| SB SB TB | .007841 |
| Total | .042808 |

where "DB" is double bar, "TB" is triple bar and "SB" is single bar.

For the Template 3 outcome DB DB TB, the probability of occurrence is 0.001514, and is calculated in the following manner:

$$P(DB\,DB\,TB) = P(T) \times \frac{P(DB)}{P(SB) + P(DB) + P(TB)} \times \frac{P(TB)}{P(SB) + P(TB)}$$

where P(T)is the template probability, P(DB) is the relative probability of occurrence of double bars, P(SB) is the relative probability of occurrence of single bars and P(TB) is the relative probability of occurrence of triple bars. For outcome DB DB TB, the probability of occurrence is:

$$0.042808 \times \frac{0.15444}{0.3861 + 0.15444 + 0.061776} \times \frac{0.061776}{0.3861 + 0.061776}$$

The probability of occurrence of a double bar in the second position is 1, because that variable is defined by the outcome of the first variable.

Once the probability of occurrence of each winning outcome template is assigned, the method of the present invention includes assigning a pay value to each outcome. The probability of occurrence of each individual winning outcome defined by each template, times the pay value for the combination, equals the total pay. The winning combinations are those that have a payout.

Table VIII below is a summary of the symbol combinations that have a pay value, the templates from which the combination originated, the probability of occurrence of the symbol combination, the assigned pay value, and the total amount paid to the player for the first example of a game configured according to the method of the present invention:

TABLE VIII

| Comb. | Temp | Prob. | Freq. | Pays | Total Pay | Max. Pay Bon. | Max. Pay Coin with Bonus |
|---|---|---|---|---|---|---|---|
| 7 7 SS | 2 | 2.17E−05 | 46136 | 760 | 0.016473 | 380 | .008237 |
| TB TB SS | 2 | 0.000173 | 5767 | 304 | 0.052714 | 0 | 0 |

TABLE VIII-continued

| Comb. | Temp | Prob. | Freq. | Pays | Total Pay | Max. Pay Bon. | Max. Pay Coin with Bonus |
|---|---|---|---|---|---|---|---|
| DB DB SS | 2 | 0.000434 | 2307 | 121.6 | 0.052714 | 0 | 0 |
| SB SB SS | 2 | 0.001084 | 923 | 18.24 | 0.019768 | 0 | 0 |
| 7 7 7 | 1 | 0.000217 | 4614 | 250 | 0.054188 | 125 | .027094 |
| TB TB TB | 1 | 0.001734 | 577 | 100 | 0.1734 | 0 | 0 |
| DB DB DB | 1 | 0.004335 | 231 | 40 | 0.1734 | 0 | 0 |
| SB SB SB | 1 | 0.010838 | 92 | 6 | 0.065025 | 0 | 0 |
| AB AB AB | 3,4 | 0.10274 | 10 | 2 | 0.205479 | 0 | 0 |
| AB AB SS | 5 | 0.006849 | 146 | 6.08 | 0.041644 | 0 | 0 |
| X X SS | 6 | 0.015411 | 65 | 1.52 | 0.023425 | 0 | 0 |
| | | 0.143836 | | | 0.87823 | | 0.03533 |

The sum of the total pays for all possible winning combinations is the percentage return to the player. In the example, the hit frequency for the game is 14.38% and the percent return to the player is 91.36% when maximum coin is played, and the second screen "balloon" feature is provided.

Table IX, below is a summary of the templates selected to define the preferred game:

TABLE IX

| Template Number | Combination Descriptor | | | Freq. | Probability |
|---|---|---|---|---|---|
| 1 | A | A | A | 1000 | 0.017123 |
| 2 | A | A | SS | 100 | 0.001712 |
| 3 | A | A | B | 2500 | 0.042808 |
| 4 | A | B | C | 3500 | 0.059932 |
| 5 | A | B | SS | 400 | 0.00G849 |
| 6 | X | Y | SS | 900 | 0.015411 |
| 7 | X | X | X | 25000 | 0.428082 |
| 8 | X | X | Y | 15000 | 0.256849 |
| 9 | X | Y | Z | 10000 | 0.171233 |
| | | | | 58400 | |

The last step of the present method includes configuring a video output gaming device 46 to randomly select an outcome template from a set of game templates, based on the probability of occurrence of each template. Each variable in the template is randomly filled from the subset of symbols assigned to the selected template. The symbols are randomly selected according to the probability of occurrence assigned to the symbol. If one or more positions in the template includes a position flag, those symbols are filled first. Preferably, active symbols are filled before inactive symbols.

Figure 4:
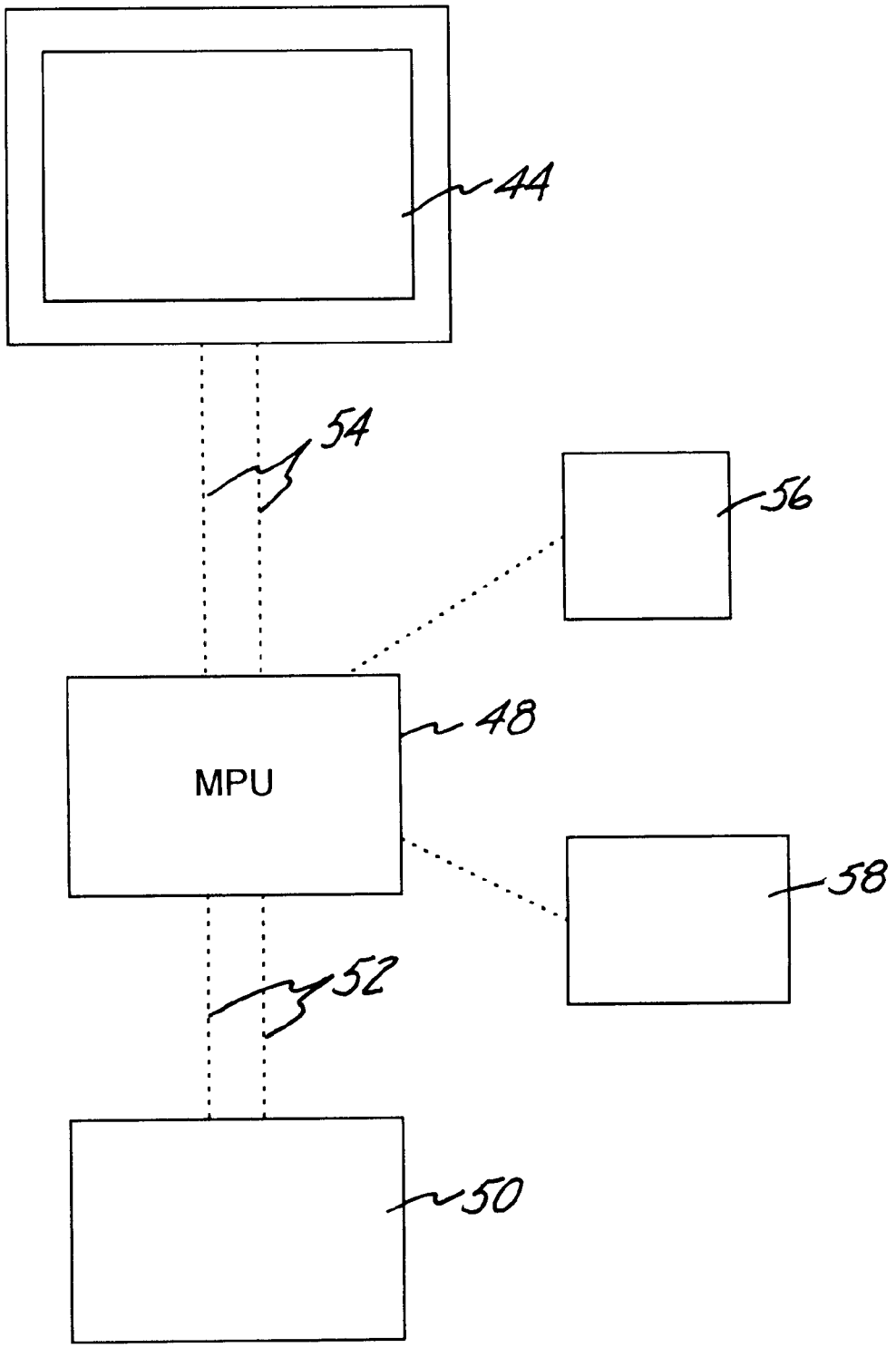
FIG. 4 is a diagrammatical illustration of the main components of the device of the present invention.

The present invention is a video output wagering device as illustrated diagrammatically in FIG. 4. The device includes a cabinet (not shown). Mounted within the cabinet is a microprocessor 48, player controls 50 and a video output display 44. The player controls 50 and video output display 44 are electronically connected for communication with microprocessor 48 via data busses 52 and 54. What is meant by "data bus" for purposes of this disclosure is electrical lines, and optionally minor electronic components. The microprocessor 48 is preferably programmed to display a symbol matching game with a second screen feature.

The microprocessor is equipped with a random number generator, and is programmed with a set of game symbols, a relative probability of occurrence assigned to each game symbol, a plurality of outcome templates, each having X variables, and an assigned relative probability of occurrence of each template. The microprocessor is further programmed to provide a subset of game symbols corresponding to each template. The microprocessor is programmed with a pay table. That is, a preselected number of symbol combinations, or outcomes and corresponding pay values are included in the programming. When a wager is placed, the device of the present invention randomly selects an outcome template, and then randomly selects a plurality of game symbols for filling the variables in the template from a subset of symbols corresponding to that template. If the outcome produces a win, the device pays the player an award according to the pay table.

Preferably, the device of the present invention defines the subset of game symbols by range and symbol grouping as described above according to the method of the present invention. Similarly, optional position flags and restrictors are provided.

In the most preferred device of the present invention, the device is programmed to display a three symbol game with a second screen feature. Alternatively, the device of the present invention utilizes templates with more or fewer variables, such as 2, 4, 5, 6 or 7, for example. The templates are preferably defined as described in the discussion of the method of the present invention, above, including the use of combination descriptors, the preferred six symbols, four corresponding symbol groupings and the preferred pay table.

Although the present invention has been described with reference to preferred embodiments, workers skilled in the art will recognize that changes may be made in form and detail without departing from the spirit and scope of the invention.

What is claimed is:

1. A method of configuring a video output gaming device to randomly generate game outcomes, comprising the steps of:

selecting a set of game symbols;

assigning a probability of occurrence to each symbol;

selecting a plurality of outcome templates, each template defining at least one combination of X variables, wherein X is a positive integer greater than 1;

selecting a probability of occurrence for each outcome template, wherein at least one template produces at least one game outcome having a probability of occurrence which is different from the probability of occurrence of an outcome of those same symbols and game symbol probabilities based on random occurrence;

assigning a subset of game symbols from the set of game symbols to each template for filling the variables;

defining payouts for selected outcomes; and configuring a video output gaming device which is programmed to randomly select symbols from the subset of game symbols assigned to the selected template to fill each variable in the template, fill at least a portion of the variables in the template randomly with the selected symbols and display the video output display.

2. The method of claim 1, wherein the subset of game symbols for filling at least one template comprises an active element.

3. The method of claim 1, wherein the subset of game symbols for filling at least one template comprises an inactive element.

4. The method of claim 1, wherein all of the selected outcome templates define fewer than all possible symbol combinations.

5. The method of claim 1 wherein the set of game symbols consists of 6 symbols, and X is equal to 3.

6. The method of claim 5, wherein the set of game symbols consists of: a special symbol, a red seven, a triple bar, a double bar and a single bar, a blank, and the payouts are as follows:

| Symbol Combination | Pays |
|---|---|
| 3 Sevens | 250 |
| 3 Triple Bars | 100 |
| 3 Double Bars | 40 |
| 3 Single Bars | 6 |
| 3 Bars (any type) | 2 |
| 1 Special Symbol | 1 |

7. The method of claim 1, wherein at least one winning combination includes at least two different symbols.

8. The method of claim 1, wherein at least one winning combination is a positional win.

9. The method of claim 1, wherein each template is defined by a combination descriptor.

10. The method of claim 9, wherein each template includes a subset of symbols from the set of game symbols, defining a range of symbols corresponding to the template.

11. The method of claim 9, wherein each template includes a variable that is filled by at least one of an active element and an inactive element.

12. The method of claim 9, and further including a positional flag in the template, wherein the variables assigned positional flags are filled first.

13. The method of claim 1, wherein 9 templates define the game.

14. The method of claim 6, wherein the special symbol appears in a single position in all outcomes including the special symbol.

15. The method of claim 6, wherein the special symbol is a wild symbol.

16. The method of claim 6, wherein the special symbol triggers a second screen feature.

17. The method of claim 16, wherein the second screen feature comprises a plurality of symbols, wherein a multiplier is associated with each symbol.

18. The method of claim 17, wherein each multiplier is concealed until the symbol is selected by the player.

19. The method of claim 17, wherein the multiplier is selected from the group: 0.5, 1, 2 and 4.

20. A video output wagering device, comprising:

a support structure;

a plurality of player controls mounted in the support structure;

a video output display mounted in the support structure; and a microprocessor mounted in the support structure, wherein the microprocessor is equipped with a random number generator, a set of game symbols, a probability of occurrence for each game symbol, a plurality of outcome templates, a probability of occurrence for each outcome template and a subset of game symbols assigned to each template, wherein each template is defined by at least one combination of X variables, wherein X is a positive integer greater than 1, wherein upon activation of the game via the player controls, the random number generator randomly selects an outcome template, and then randomly selects X game symbols for defining the variables in the template from the subset of game symbols assigned to the selected template, and randomly assigns an order of appearance of at least some of the selected symbols in the game outcome displayed on the video output display, wherein at least one template produces at least one game outcome having a probability of occurrence which is different from the probability of occurrence of an outcome of those same symbols and game symbol probabilities based on random occurrence;

and awards a payout if the symbols on the pay line correspond to one of a preselected group of winning symbol combinations.

21. The apparatus of claim 20, wherein the subset of game symbols is further defined by at least one selected symbol grouping, and a range of selected symbol groupings which can be used to fill the corresponding template.

22. The apparatus of claim 20, wherein X is equal to 3.

23. The apparatus of claim 20, wherein each template is defined by a combination descriptor.

24. The apparatus of claim 20, wherein the game symbols are: red seven, triple bar, double bar, single bar, special symbol and blank.

25. The apparatus of claim 24, wherein the preselected group of winning symbol combinations and payouts are:

| | |
|---|---|
| 3 red sevens | 250 |
| 3 triple bars | 100 |
| 3 double bars | 40 |
| 3 single bars | 6 |
| 3 bars (any type) | 2 |
| 1 special symbol | 1 |

26. The apparatus of claim 20, wherein at least one winning combination includes at least two different symbols.

27. The apparatus of claim 20, wherein at least one preselected winning symbol combination is a positional win.

28. The apparatus of claim 24, wherein the special symbol appears in only one position on the video output display.

29. The apparatus of claim 24, wherein the special symbol is a wild symbol.

30. The apparatus of claim 24, wherein the special symbol triggers a second screen feature.

31. The apparatus of claim 24, wherein the second screen feature displays a plurality of symbols, wherein a multiplier is associated with each symbol.

32. The apparatus of claim 24, wherein each multiplier is concealed until selected by the player.

33. The apparatus of claim 24, wherein the multiplier is selected from the group: 0.5, 1, 2 and 4.

34. The apparatus of claim 33, wherein a plurality of multipliers is provided, and the player selects a multiplier which is multiplied by a payout of an underlying game to determine the game payout assigned to the game outcome.

35. The apparatus of claim 21, wherein the subset of symbols corresponding to each template is further defined by a position restrictor and a position flag.

* * * * *